US005674669A

United States Patent [19]

Gallo et al.

[11] Patent Number: 5,674,669

[45] Date of Patent: Oct. 7, 1997

[54] PHOTOGRAPHIC ELEMENTS CONTAINING OXONOL FILTER DYE MIXTURE AND THEIR PREPARATION

[75] Inventors: Elizabeth Ann Gallo; Donald Richard Diehl, both of Rochester, N.Y.

[73] Assignee: Eastman Kodak Company, Rochester, N.Y.

[21] Appl. No.: 429,382

[22] Filed: Apr. 26, 1995

[51] Int. Cl.[6] ..... G03C 1/815

[52] U.S. Cl. ..... 430/512; 430/522

[58] Field of Search ..... 430/512, 522

[56] References Cited

U.S. PATENT DOCUMENTS

| | | | |
|---|---|---|---|
| 4,130,430 | 12/1978 | Sugiyama et al. | 96/84 |
| 5,236,807 | 8/1993 | Inoue et al. | 430/512 |
| 5,312,724 | 5/1994 | Harada et al. | 430/522 |

FOREIGN PATENT DOCUMENTS

| | | |
|---|---|---|
| 0 362 734 | 4/1990 | European Pat. Off. . |
| 5-297517 | 11/1993 | Japan . |

*Primary Examiner*—Janet C. Baxter

*Attorney, Agent, or Firm*—Edith A. Rice; Gordon M. Stewart

[57] ABSTRACT

A photographic element having a support and a layer containing first and second oxonol dyes, the first dye being a monomethine pyrazolone oxonol dye with each pyrazolone ring having a 1-phenyl group bearing an ortho-substituent selected from sulfo, sulfato, hydroxy, or nitro substituent, and the second dye being a tri- or penta-methine oxonol dye. A method of making a photographic element is also provided. The method comprises maintaining a mixture of at least such a first dye in a carrier medium at a temperature of at least 30° C. for 0.5 hour.

2 Claims, No Drawings

PHOTOGRAPHIC ELEMENTS CONTAINING OXONOL FILTER DYE MIXTURE AND THEIR PREPARATION

FIELD OF THE INVENTION

This invention relates to photographic elements containing a mixture of dyes, particularly a mixture of oxonol dyes, and a method of making such photographic elements.

BACKGROUND

Filter dyes are used in photographic materials to absorb light from different regions of the spectrum, such as red, green, blue, ultraviolet and infrared. Such light absorbance by filter dyes is useful in silver halide photographic materials to provide control of the sensitivity of the silver halide emulsions to light, and also to provide improvements in sharpness of the silver halide emulsions during exposure. It is common in the design of new photographic materials to choose filter dyes with specific light filtration characteristics. It may be desirable to use a particular filter dye which has light absorbance properties in more than one region of the spectrum, for example a dye which has good light absorbance in both the blue region as well as the ultraviolet region. Filter dyes that provide light filtration in multiple regions of the spectrum are particularly desirable in certain photographic applications since this allows the use of fewer dyes to absorb several different regions of light.

The continued presence of the filter dyes in photographic materials after processing in aqueous developing solutions is undesirable. Therefore, photographic filter dyes are designed to be decolorized by processing solutions so as to remove all traces of residual dye. Oxonol filter dyes which absorb in various regions of the spectrum and are readily removed during processing, are particularly known for use in photographic elements. Such dyes include Tartrazine and Oxonol Yellow, which have the following structures:

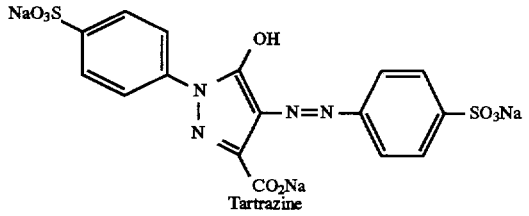

Tartrazine

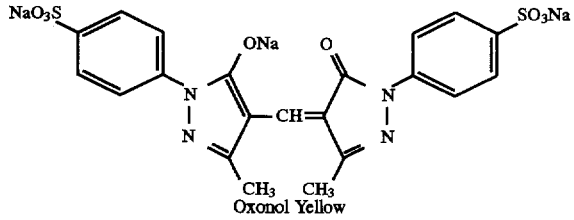

Oxonol Yellow

While Tartrazine has good light absorbance in the region of 400–450 nm it has no appreciable light absorbance in the region of 300–350 nm. Simultaneous light absorbance in the 300–350 nm region, as well as the 400–450 nm region is a desirable feature in certain graphic arts materials. Therefore, Tartrazine is generally not used as a filter dye in graphic arts photographic materials. Oxonol Yellow does however, have high light absorbance in both the 300–350 nm region as well as the 400–450 nm region.

Various other oxonol dyes are also known. For example, such dyes are disclosed in Japanese published patent applications (Kokai) JP 3132654, JP 3209446, JP 3209467, JP 4186339 and JP 3223843.

In the manufacture of photographic materials, though, it is common to coat melted gelatin solutions containing solutions or dispersions of photographically useful compounds. The melting of these mixtures may take place immediately prior to the coating operation. However, it is also common to melt the mixture of gelatin and photographically useful materials, then hold that mixture at temperatures above room temperature for an extended period of time (the "melt hold" time) before the actual coating operation is conducted. Such a manufacturing method is common in a "roll coating" operation because it is efficient and very economical. Such "roll coating" operations particularly have application in the manufacture of graphic arts photographic materials.

However, a problem common to the "roll coating" operation is the decomposition or degradation of the coating mixture. Both the melted gelatin and the incorporated photographically useful materials should be stable during the melt hold time. Decomposition or degradation of the photographically useful material can be particularly severe in gelatin melts containing photographic filter dyes.

It would be desirable then, to provide photographic elements which use a mixture of oxonol dyes which exhibits good stabiity during a melt hold. A method of making photographic elements containing at least one such dye, which results in low dye decomposition, is also desirable.

SUMMARY OF THE INVENTION

We have discovered that certain monomethine oxonol filter dyes apparently decompose during a melt hold. Further, their presence apparently increases the decomposition of other oxonol filter dyes present. Accordingly, the present invention provides a photographic element having a support and a layer containing both a first oxonol dye and a second oxonol dye. The first dye is a monomethine pyrazolone oxonol dye with each pyrazolone ring having a 1-phenyl group bearing an ortho-substituent selected from sulfo or sulfato. The second dye is a tri- or penta-methine oxonol dye. The present invention also provides a method of making photographic elements containing at least the first dye, comprising maintaining the first dye in a carrier medium (preferably gelatin) at a temperature of at least 30° C. (and preferably at least 32° C. in order to maintain the gelatin in melted state) for at least 0.5 hour.

Photographic elements of the present invention can have good light absorption in different spectral regions. Additionally, they allow the carrier medium (for example, gelatin) containing the two dyes, to be held at a high temperature for a substantial length of time with low resultant apparent dye decomposition.

EMBODIMENTS OF THE INVENTION

In the present application, reference to "under", "above", "below", "upper", "lower" or the like terms in relation to layer structure of a photographic element, is meant the relative position in relation to light when the element is exposed in a normal manner. "Above" or "upper" would mean closer to the light source when the element is exposed normally, while "below" or "lower" would mean further from the light source. Since a typical photographic element has the various layers coated on a support, "above" or "upper" would mean further from the support, while "below" or "under" would mean closer to the support. Further, reference to any chemical "group" (such as alkyl group, aryl group, heteroaryl group, and the like) includes the possibility of it being both substituted or unsubstituted (for example, alkyl group and aryl group include substituted and unsubstituted alkyl and substituted and unsubstituted aryl, respectively).

Generally, unless otherwise specifically stated, substituent groups on dyes of the present invention include any groups, whether substituted or unsubstituted, which do not destroy the properties necessary for the photographic utility (in particular, their utility as dyes). It will also be understood throughout this application that reference to a compound of a particular general formula includes those compounds of other more specific formula which specific formula falls within the general formula definition. It will also be understood that a pyrazolone oxonol dye is an oxonol dye having both nuclei being pyrazolones. Thus, a 1-phenyl pyrazolone oxonol dye in which each 1-phenyl has an ortho substituent selected from the above described class, would have the following general structure:

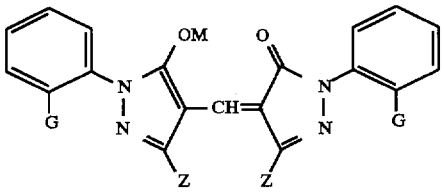

Where G is one of the the ortho substituents described above (preferably sulfo or sulfato), each G may be the same or different; each Z is a substituent and may be the same or different; M is H or a cation, and; the phenyl rings may be further substituted. As is known, when M is H such dyes have tautomeric forms which are included in the above structure. When M is a cation, known resonance structures can be drawn which are all within the above formula. Whether a substituent on either phenyl ring is ortho, meta or para, is in relation to the bond between the phenyl ring and the pyrazolone nitrogen.

The first dye is preferably a monomethine pyrazolone oxonol dye of formula (I) below:

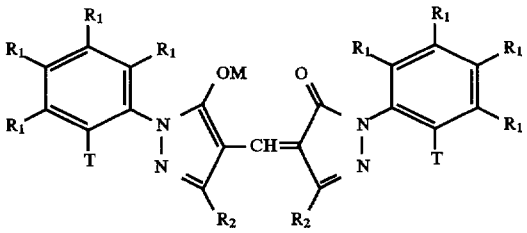

(I)

wherein: T is sulfo or sulfato; each $R_2$ is, independently, H, cyano, alkyl group, alkoxy group, aryl group, aryloxy group, hydroxyl, acyl group, amino group, carbonamido group, or carbamoyl group; each $R_1$ is, independently, any of those groups which $R_2$ can be or sulfo or sulfato, and; M is a cation or H.

Dyes of formula (I) further may be symmetrical or unsymmetrical (that is, symmetrical dyes would have the same structure about the center methine of the methine chain).

As for the second dye, nuclei which can be linked by the trimethine or pentamethine bridge to form the second oxonol dye are described in F. M. Hamer, *Cyanine Dyes and Related Compounds*, Wiley, New York, 1964. Such nuclei include: 2-pyrazolin-5-one, pyrazolindione, barbituric acid, rhodanine, indandione, benzofuranone, chromandione, cyclohexanedione, dioxanedione, furanone, isoxazolinone, pyridone, isoxazolidinedione, and pyrandione.

The second dye preferably has at least one pyrazolone or pyrazolindione ring connected to a tri- or penta-methine bridge. Further preferably, such pyrazolone or pyrazolindione ring of the second dye has a 1-phenyl substituent which most preferably has a meta or para sulfo or sulfato substituent (defined in relation to the bond between the phenyl ring and the pyrazolone or pyrazolindione ring nitrogen). Particular dye structures of the second dye are those of formula (II) or (III) below:

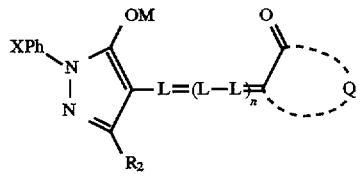

(II)

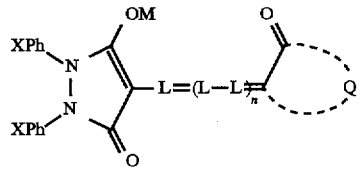

(III)

In formula (II) and (III): each $R_2$ is, independently, H, cyano, alkyl group, alkoxy group, aryl group, aryloxy group, hydroxyl, acyl group, amino group, carbonamido group, or carbamoyl group; M is a cation or H; each XPh independently represents a phenyl with a meta- or para- sulfo or sulfato substituent; each L independently represents a methine group; n is 1 or 2, and; Q represents the atoms necessary to complete a 5 or 6 membered cyclic or heterocyclic group.

In the above formula (II) or (III), Q may particularly represent a pyrazolone group, pyrazolindione group, barbituric acid group, or thiobarbituric acid group. Dyes of formula (II) and (III) may particularly be dyes of formula (IIA) and (IIIA), respectively:

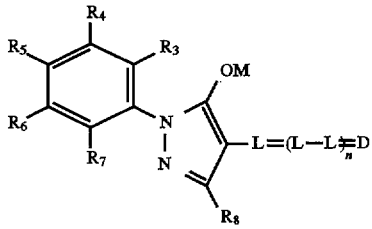

(IIA)

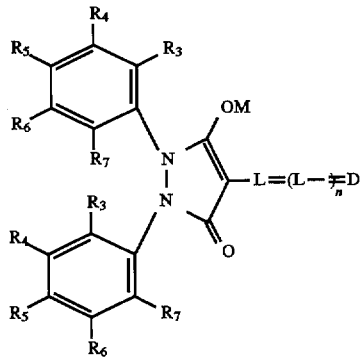

(IIIA)

wherein: each $R_8$ is, independently, H, cyano, alkyl group, alkoxy group, aryl group, aryloxy group, hydroxyl, acyl group, amino group, carbonamido group, or carbamoyl group; each of $R_3$ to $R_7$ is, independently, any of those groups which $R_8$ can be or sulfo or sulfato, provided that at least one of them is a sulfo or sulfato; each L is, independently, a methine group; n and M are as defined above; and D is selected from:

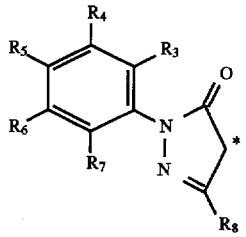

OR

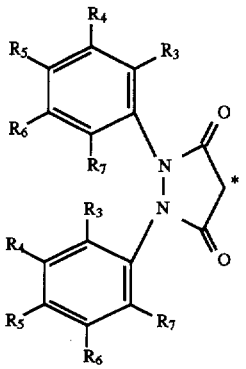

OR

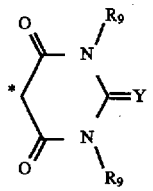

wherein: $R_3$ to $R_8$ are as defined above; each $R_9$ is independently, an alkyl group; and Y is O or S. Dyes of formula (IIA) and (IIIA) may be chosen with the same or different nucleus on either end of the methine chain, and further may be symmetrical or unsymmetrical (that is, symmetrical dyes would have the same structure about the center methine of the methine chain).

Acyl groups described above include aldehyde, carboxyl, alkylcarbonyl, arylcarbonyl, aryloxycarbonyl or alkoxycarbonyl. Any of the substituted or unsubstituted alkyl or alkoxy described herein for any of the substituents (particularly any of the R substituents) may include a substituted or unsubstituted alkyl (including cycloalkyl) or alkoxy of 1 to 20 (preferably 1 to 8) carbon atoms. Examples of unsubstituted alkyl groups are methyl, ethyl, propyl, isopropyl, butyl, isobutyl, t-butyl, pentyl, hexyl, octyl, 2-ethylhexyl, and the like. Cycloalkyl groups may particularly be of 5 to 14 carbon atoms, and can include cyclopentyl, cyclohexyl, 4-methylcyclohexyl, and the like. Any alkenyl substituents can be 2 to 20 (preferably 2 to 8) carbon atoms. Examples of alkenyl groups can be vinyl, 1-propenyl, 1-butenyl, 2-butenyl, and the like. Any of the aryl or aryloxy groups can particularly have from 6 to 14 carbon atoms. Aryl may include phenyl, naphthyl, styryl, and the like, while aryloxy groups may include the oxy derivatives of the foregoing aryl groups. Useful heterocyclic groups may particularly be of 5 to 14 carbon atoms and can include substituted or unsubstituted thiazole, selenazole, oxazole, imidazole, indole, benzothiazole, benzindole, naphthothiazole, naphthoxazole, benzimidazole, pyridine, pyrazole, pyrrole, furan, thiophene, and the like. Substituents on any of the foregoing alkyl, alkenyl, aryl, heterocyclic or other groups can include, for example, aryl. Thus, a substituted alkyl includes aralkyl such as benzyl, phenethyl, and the like. While the methines, L, may be unsubstituted, any of them may optionally be substituted with groups such as an alkyl group (including sulfoethyl), alkoxy group, aryloxy group, aryl group, carboxy group, halogen, cyano, and the like. Substituted methines include the possibility that any of the methines together with a suitable number of other atoms, may form a carbocyclic (particularly cycloalkyl) or heterocyclic ring, particularly a substituted or unsubstituted cyclopentyl or cyclohexyl ring. For example, a cyclohexyl group may be formed from the middle methine carrying the acyl group, together with the carbon on either side thereof plus three additional carbon atoms.

Useful substituents for any of the alkyl, alkenyl, aryl, heterocyclic, or other groups described above include halogen (such as chloro or fluoro), alkoxy (particularly of from 1 to 6 carbon atoms), acyl, alkoxycarbonyl, aminocarbonyl, carbonamido, carboxy, sulfamoyl, sulfonamido, sulfo, nitro, hydroxy, amino, cyano and the like.

As already mentioned the present invention provides a method of making a photographic element which comprises maintaining a mixture of at least the monomethine first dye of any of the types or formulae described above, in a carrier medium (which is preferably a gelatin medium) at a temperature of at least 30° C. (preferably, at least 32° C.) for 0.5 hour. However, the same method can be used to make any coating containing such a dye or dyes, other than a photographic element specifically.

In the method, the mixture preferably additionally contains the second dye in the carrier medium, the second dye being of the type or formulae already described in detail above.

Preferably the temperature at which the mixture is maintained is at least 32° C. (and more preferably at least 40° or even 50° C.), and the mixture is maintained at such temperature for at least 2 hours (or even at least 3 hours) for up to various lengths of time (such as up to 24 hours).

The first and second dyes of the formula (I) can be present within a silver halide emulsion layer of a photographic element as an intergrain absorber or immobilized by cationic mordants in a separate layer, or coated in a layer on the support on the side opposite to the layers containing silver halide emulsions. Such dyes would readily wash out of the silver halide emulsions upon normal photographic processing. If the dyes are provided with suitable ballast groups such that they are not removed from photographic elements during processing, they can also function, particularly in color negative materials, as printer compatibility dyes to add $D_{min}$ at desired wavelenghts.

Amounts of each of the first and second dyes described which can be used in photographic elements of the present invention can vary widely. Particularly the amount of each dye used in such elements is from 0.1 mg/m$^2$ to 1000 mg/m$^2$, or preferably from 1 mg/m$^2$ to 300 mg/m$^2$.

More generally, dyes of the formula (I) may be in a hydrophilic layer of a photographic element which is either a radiation sensitive layer or a non-radiation sensitive layer (for example, either contains light sensitive silver halide or not). Further, the dyes may be located on the same side of a support of a photographic element as a radiation sensitive layer, or on the opposite side of the support. More specifically, the dyes can be incorporated in an anti-halation layer or an anti-halation subbing layer.

Examples of the first dye are Dye 1, Dyes 1A through 1C, Dye 2 and Dyes 2A through 2C, all shown below (note, "Ph" represents phenyl):
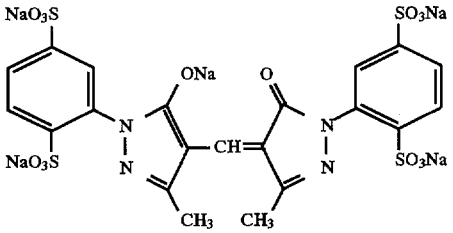
Dye 1
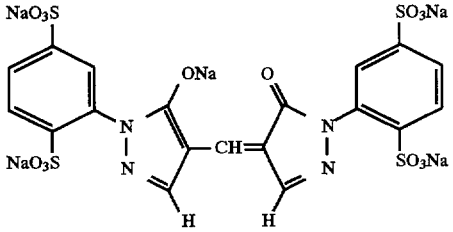
Dye 1A
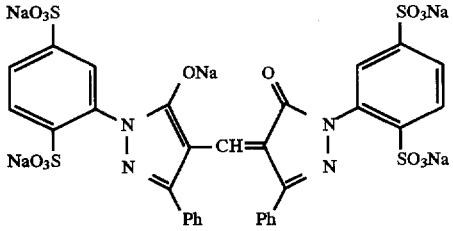
Dye 1B
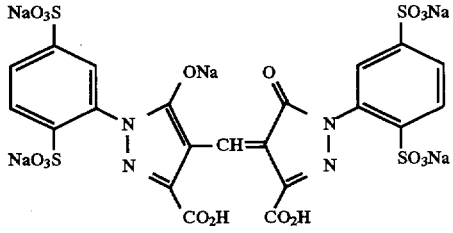
Dye 1C
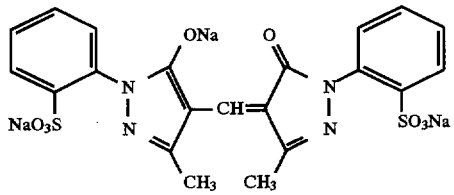
Dye 2
-continued
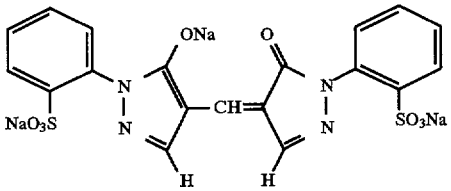
Dye 2A
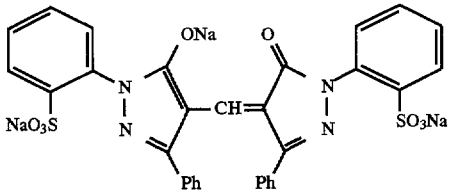
Dye 2B
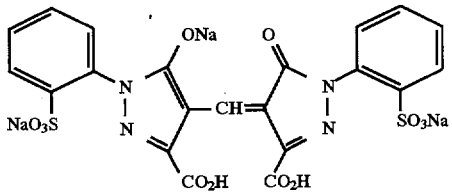
Dye 2C
Examples of the second dye described above, are Dyes 3–9 shown below:
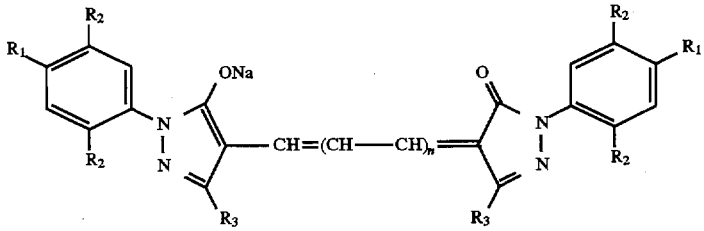
Dye 3 $R_1 = SO_3Na$ $R_2 = H$ $R_3 = Me$ $n = 1$
Dye 4 $R_1 = H$ $R_2 = SO_3Na$ $R_3 = Ac$ $n = 1$
Rye 5 $R_1 = SO_3Na$ $R_2 = H$ $R_3 = Me$ $n = 2$
Dye 6 $R_1 = H$ $R_2 = SO_3Na$ $R_3 = Ac$ $n = 2$ -continued

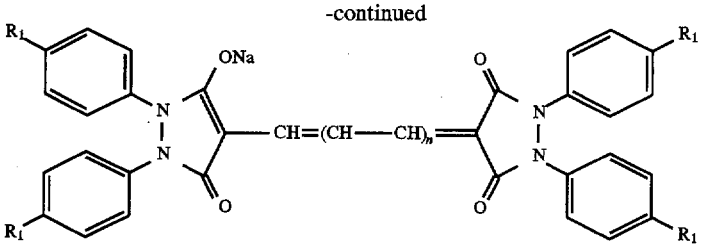

Dye 7 R1 = $SO_3Na$ n = 1
Dye 8 $R_1$ = $SO_3Na$ n = 2

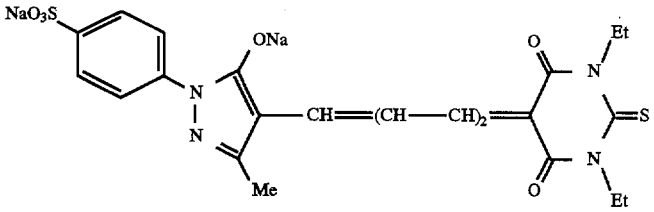

Dye 9

Dyes of the type required may generally be prepared using known methods such as described in Hamer, *Cyanine Dyes and Related Compounds,* 1964 (publisher John Wiley & Sons, New York, N.Y.). In particular, dyes of the first dye type (the monmethine pyrazolone oxonols) required by the present invention can be prepared in a manner similar to that described for Dye 1, as described in detail below.

Photographic elements according to the present invention will typically have at least one light sensitive silver halide emulsion layer and a support.

Photographic elements of the present invention can be single color elements but are preferably multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element of the present invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. All of these can be coated on a support which can be transparent or reflective (for example, a paper support). Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. No. 4,279,945 and U.S. Pat. No. 4,302,523. The element typically will have a total thickness (excluding the support) of from 5 to 30 microns. While the order of the color sensitive layers can be varied, they will normally be red-sensitive, green-sensitive and blue-sensitive, in that order on a transparent support, with the reverse order on a reflective support being typical.

Photographic elements of the present invention can be used in conventional cameras including what are often referred to as single use cameras (or "film with lens" units). These cameras are sold with film preloaded in them and the entire camera is returned to a processor with the exposed film remaining inside the camera. Such cameras may have glass or plastic lenses through which the photographic element is exposed. However, the color reversal elements of the present invention are preferably used by exposing in an electronic film writer as described above.

In the following discussion of suitable materials for use in elements of this invention, reference will be made to *Research Disclosure,* September 1994, Number 365, Item 36544, published by Kenneth Mason Publications, Ltd., Dudley Annex, 12a North Street, Emsworth, Hampshire P010 7DQ, ENGLAND, which will be identified hereafter by the term "Research Disclosure I." The Sections hereafter referred to are Sections of the Research Disclosure I.

The silver halide emulsions employed in the photographic elements may be negative-working, such as surface-sensitive emulsions or unfogged internal latent image forming emulsions, or positive working emulsions of internal latent image forming emulsions (that are either fogged in the element or fogged during processing). Suitable emulsions and their preparation as well as methods of chemical and spectral sensitization are described in Sections I through V. Color materials and development modifiers are described in Sections V through XX. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in in Section XI, exposure alternatives in Section XVI (although again, exposure of the reversal film element of the present invention in a film writer, is preferred), and processing methods and agents in Sections XIX and XX (although the present invention requires reversal processing of the element, as already defined above).

Supports for photographic elements of the present invention include polymeric films such as cellulose esters (for example, cellulose triacetate and diacetate) and polyesters of dibasic aromatic carboxylic acids with divalent alcohols (for example, poly(ethylene-terephthalate), poly(ethylene-napthalates)), paper and polymer coated paper. Such supports are described in further detail in *Research Disclosure I*, Section XV.

The photographic elements may also contain materials that accelerate or otherwise modify the processing steps of bleaching or fixing to improve the quality of the image. Bleach accelerators described in EP 193,389; EP 301,477; U.S. Pat. No. 4,163,669; U.S. Pat. No. 4,865,956; and U.S. Pat. No. 4,923,784 are particularly useful. Also contemplated is the use of nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the couplers may be blocked or coated in protected form as described, for example, in Japanese Application 61/258,249 or U.S. Pat. No. 5,019,492.

The photographic elements may further contain other image-modifying compounds such as "Developer Inhibitor-Releasing" compounds (DIR's). DIR compounds are disclosed, for example, in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. DIRs that have particular application in color reversal elements are disclosed in allowed U.S. patent applications Ser. Nos. 08/004,019, 08/005,319, 08/005,472, and 08/007,440.

It is also contemplated that the concepts of the present invention may be employed to obtain reflection color prints. The emulsions and materials to form elements of the present invention, may be coated on pH adjusted support as described in U.S. Pat. No. 4,917,994; with epoxy solvents (EP 0 164 961); with additional stabilizers (as described, for example, in U.S. Pat. No. 4,346,165; U.S. Pat. No. 4,540,653 and U.S. Pat. No. 4,906,559); with ballasted chelating agents such as those in U.S. Pat. No. 4,994,359 to reduce sensitivity to polyvalent cations such as calcium; and with stain reducing compounds such as described in U.S. Pat. No. 5,068,171 and U.S. Pat. No. 5,096,805. Other compounds useful in the elements of the invention are disclosed Japanese Published Applications 83-09,959; 83-62,586; 90-072,629, 90-072,630; 90-072,632; 90-072,633; 90-072,634; 90-077,822; 90-078,229; 90-078,230; 90-079,336; 90-079,338; 90-079,690; 90-079,691; 90-080,487; 90-080,489; 90-080,490; 90-080,491; 90-080,492; 90-080,494; 90-085,928; 90-086,669; 90-086,670; 90-087,361; 90-087,362; 90-087,363; 90-087,364; 90-088,096; 90-088,097; 90-093,662; 90-093,663; 90-093,664; 90-093,665; 90-093,666; 90-093,668; 90-094,055; 90-094,056; 90-101,937; 90-103,409; 90-151,577.

The silver halide used in the photographic elements of the present invention may be silver iodobromide, silver bromide, silver chloride, silver chlorobromide, silver chloroiodobromide, and the like.

For example, the silver halide used in the photographic elements of the present invention may contain at least 90% silver chloride or more (for example, at least 95%, 98%, 99% or 100% silver chloride). Even in such high chloride emulsions, some silver bromide (although in such elements, typically substantially no silver iodide is present). Substantially no silver iodide means the iodide concentration should be no more than 1%, and preferably less than 0.5 or 0.1%. In particular, in such high chloride emulsions, the possibility is contemplated that the silver chloride could be treated with a bromide source to increase its sensitivity, although the bulk concentration of bromide in the resulting emulsion will typically be no more than about 2 to 2.5% and preferably between about 0.6 to 1.2% (the remainder being silver chloride). The foregoing % figures are mole %.

The type of silver halide grains preferably include polymorphic, cubic, and octahedral. The grain size of the silver halide may have any distribution known to be useful in photographic compositions, and may be ether polydipersed or monodispersed.

Tabular grain silver halide emulsions may also be used. Tabular grains are those with two parallel major faces each clearly larger than any remaining grain face and tabular grain emulsions are those in which the tabular grains account for at least 30 percent, more typically at least 50 percent, preferably >70 percent and optimally >90 percent of total grain projected area. The tabular grains can account for substantially all (>97 percent) of total grain projected area. The tabular grain emulsions can be high aspect ratio tabular grain emulsions—i.e., ECD/t>8, where ECD is the diameter of a circle having an area equal to grain projected area and t is tabular grain thickness; intermediate aspect ratio tabular grain emulsions—i.e., ECD/t=5 to 8; or low aspect ratio tabular grain emulsions—i.e., ECD/t=2 to 5. The emulsions typically exhibit high tabularity (T), where T (i.e., $ECD/t^2$) >25 and ECD and t are both measured in micrometers (μm). The tabular grains can be of any thickness compatible with achieving an aim average aspect ratio and/or average tabularity of the tabular grain emulsion. Preferably the tabular grains satisfying projected area requirements are those having thicknesses of <0.3 μm, thin (<0.2 μm) tabular grains being specifically preferred and ultrathin (<0.07 μm) tabular grains being contemplated for maximum tabular grain performance enhancements. When the native blue absorption of iodohalide tabular grains is relied upon for blue speed, thicker tabular grains, typically up to 0.5 μm in thickness, are contemplated.

High iodide tabular grain emulsions are illustrated by House U.S. Pat. No. 4,490,458, Maskasky U.S. Pat. No. 4,459,353 and Yagi et al EPO 0 410 410.

Tabular grains formed of silver halide(s) that form a face centered cubic (rock salt type) crystal lattice structure can have either {100} or {111} major faces. Emulsions containing {111} major face tabular grains, including those with controlled grain dispersities, halide distributions, twin plane spacing, edge structures and grain dislocations as well as adsorbed {111} grain face stabilizers, are illustrated in those references cited in *Research Disclosure I*, Section I.B.(3) (page 503).

The silver halide grains to be used in the invention may be prepared according to methods known in the art, such as those described in *Research Disclosure I* and James, *The Theory of the Photographic Process*. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with noble metal (for example, gold) sensitizers, middle chalcogen (for example, sulfur) sensitizers, reduction sensitizers and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle (sometimes referenced as a "medium" or "carrier medium" in this application) for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as described in *Research Disclosure I*, Section IV (pages 510–511) and the references cited therein.

The silver halide may be sensitized by sensitizing dyes by any method known in the art, such as described in *Research Disclosure I*. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alocohol. The dye/silver halide emulsion may be mixed with a dispersion of color image-forming coupler immediately before coating or in advance of coating (for example, 2 hours).

The present invention also specifically contemplates multilayer photographic elements as described in *Research Disclosure*, February 1995, Item 37038 (pages 79–115). Particularly contemplated is the use of a first dye of the present invention in combination with a second dye, in such elements. Particularly, any one of Dyes 1, Dyes 1A through 1C, Dye 2, or Dyes 2A through 2C, could be used in combination with any of Dyes 3 to 9 above in the Antihalation layer of each of the photographic elements described in detail in Sections XIX through XXII of that *Research Disclosure*.

Photographic elements of the present invention can be imagewise exposed using any of the known techniques, including those described in *Research Disclosure I*, section XVI. This typically involves exposure to light in the visible region of the spectrum, and typically such exposure is of a live image through a lens. However, the photographic elements of the present invention are preferably exposed in a film writer as described above. Exposure in a film writer is an exposure to a stored image (such as a computer stored image) by means of light emitting devices (such as light controlled by light valves, CRT and the like).

Photographic elements comprising the composition of the invention can be processed in any process, particularly color negative or color reversal process. In a color negative process, the element is treated with a color developer. In a color reversal process, the element is first treated with a black and white developer, followed by fogging non-exposed grains using chemical or light fogging, followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is followed by bleach-fixing, to remove silver or silver halide, washing and drying. Bleaching and fixing can be performed with any of the materials known to be used for that purpose. Bleach baths generally comprise an aqueous solution of an oxidizing agent such as water soluble salts and complexes of iron (III)(e.g., potassium ferricyanide, ferric chloride, ammonium or potassium salts of ferric ethylenediaminetetraacetic acid), water-soluble persulfates (e.g., potassium, sodium, or ammonium persulfate), water-soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The present invention will be further described in the examples below.

Preparation of Dye 1

Into a 100 mL flask was placed 7.5 grams of 1-(2,5-disulfophenyl)-3-methyl-2-pyrazolin-5-one, disodium salt, 16.2 grams of diethoxymethylacetate, 20 mL of dimethylsulfoxide, and 4.4 grams of triethylamine. The mixture was stirred and heated at 100° C. for 90 minutes. The product mixture was cooled to room temperature, diluted with 60 mL of ethanol and the crude product was collected by filtration. The crude dye was purified and converted to the sodium salt by dissolving in 20 mL of water, adding 3.0 grams of sodium iodide, and precipitating with 200 mL of ethanol. The yield was 4.0 grams (25%) of yellow dye. Absorbance maximum 425 nm (water), molar extinction 21,900.

Dye 2 was prepared using a procedure similar to that for Dye 1.

Preparation of Gelatin Melt Hold Solutions

A slurry of 0.8 grams of dry bone gelatin in 15.0 grams of water was heated until the gelatin dissolved. To the warm solution was added 0.3 grams of aqueous 10% Olin 10 G surfactant solution and 0.2 grams of aqueous 10% 2,3-dihydroxy-1,4-dioxane solution. The dyes were dissolved in a minimum of water and added to the gelatin solution. The total weight of the gelatin melt solution was adjusted to 35.0 grams with water. The pH of the melt solution was then adjusted with one molar sulfuric acid and/or one molar sodium hydroxide solution to give a pH of 5.0. The stabilities of the dyes in the gelatin melt solutions were investigated over the temperature range of 32°–55° C. (90°–140° F.). Visible absorbance spectra were measured from solutions in which aliquots of the gelatin melt solutions were diluted 200× with distilled water. The results are shown in Table 1 below.

TABLE 1

Gelatin Melt Hold Stabilities of Oxonol Dyes

| | Dye in Melt | % Loss yellow dye | % Loss cyan dye |
|---|---|---|---|
| 1. | Oxonol yellow (comparative) | 10 | — |
| 2. | Dye 1 | 6 | — |
| 3. | Oxonol Yellow + Dye 6 (comparative) | 45 | 97 |
| 4. | Dye 1 + Dye 6 | 3 | 2 |

The data in Table 1 demonstrates that the dyes of this invention have greater stability in gelatin melt hold conditions than a monomethine oxonol dye previously known in the art, and the dyes of this invention do not cause significant degradation or decomposition under melt hold conditions of another oxonol dye used in combination.

Additional Dye Stability Tests

In a second set of experiments, stability of the dyes was measured without the presence of the gelatin, surfactant and hardener. As shown below, the same relative results were obtained as in the above gelatin tests. Measurements were conducted in water at pH 5.0 at 55° C. These conditions were used to generate the data shown in Tables 2 and 3 below.

TABLE 2

Solution Stabilities of Monomethine Oxonol Dyes (pH 5.0, 55° C., 24 hours)

| Sample | Dye in Solution | % Loss |
|---|---|---|
| 1. | Oxonol yellow (comparative) | 40 |
| 2. | Dye 1 | 2 |
| 3. | Dye 2 | 3 |

TABLE 3

Solution Stabilities of Mixtures of Oxonol Dyes (pH 5.0, 55° C., 24 hours)

| Sample | Cyan or Magenta Oxonol Dye | % Loss with Oxonol Yellow Present | % Loss with Dye 1 Present |
|---|---|---|---|
| 1 | Dye 3 | 30 | 5 |
| 2 | Dye 4 | 90 | 0 |
| 3 | Dye 5 | 100 | 82 |
| 4 | Dye 6 | 100 | 3 |
| 5 | Dye 7 | 43 | 0 |
| 6 | Dye 8 | 90 | 22 |
| 7 | Dye 9 | 100 | 43 |

The preceding examples are set forth to illustrate specific embodiments of this invention and are not intended to limit the scope of the compositions or materials of the invention. It will be understood that variations and modifications can be effected within the spirit and scope of the invention.

We claim:

1. A method of making a photographic element, comprising maintaining a mixture of first and second oxonol dyes in a carrier medium at a temperature of at least 50° C. for at least 0.5 hour, the first dye being a monomethine pyrazolone oxonol dye with a 1-phenyl group bearing an ortho-substituent selected from sulfo or sulfato and said second dye being tri- or penta-methine oxonol dye.

2. A method according to claim 1 wherein the carrier medium is gelatin and the mixture is held at a temperature of at least 50° C. for at least 2 hours.

* * * * *